US008834640B2

(12) United States Patent
Kappel et al.

(10) Patent No.: US 8,834,640 B2
(45) Date of Patent: Sep. 16, 2014

(54) METHOD AND DEVICE FOR TREATING CONTAINERS

(75) Inventors: Steffen Kappel, Bad Kreuznach (DE); Thomas Ludwig, Weil am Rhein (DE)

(73) Assignee: KHS GmbH, Dortmund (DE)

( * ) Notice: Subject to any disclaimer, the term of this patent is extended or adjusted under 35 U.S.C. 154(b) by 612 days.

(21) Appl. No.: 13/128,100

(22) PCT Filed: Dec. 15, 2009

(86) PCT No.: PCT/EP2009/008975

§ 371 (c)(1),
(2), (4) Date: May 6, 2011

(87) PCT Pub. No.: WO2010/075955

PCT Pub. Date: Jul. 8, 2010

(65) Prior Publication Data

US 2011/0209724 A1 Sep. 1, 2011

(30) Foreign Application Priority Data

Dec. 17, 2008 (DE) ..... 10 2008 062 378

(51) Int. Cl.

| | |
|---|---|
| ***B08B 5/02*** | (2006.01) |
| ***A47L 13/40*** | (2006.01) |
| ***B08B 9/34*** | (2006.01) |
| ***B08B 6/00*** | (2006.01) |

(52) U.S. Cl.

CPC .... *B08B 9/34* (2013.01); *B08B 6/00* (2013.01)

USPC ..... 134/21; 134/22.12; 134/31; 134/37; 15/300.1; 15/306.1; 15/309.1; 141/63; 141/89; 141/91

(58) Field of Classification Search

CPC ..... B08B 5/02; B08B 5/04; B08B 1/02

USPC ..... 134/21, 22.1, 22.12, 25.2, 25.1, 25.3, 134/31, 37; 15/303, 306, 309.2; 141/89, 91, 141/63, 7, 8, 4

See application file for complete search history.

(56) References Cited

U.S. PATENT DOCUMENTS

| | | | | |
|---|---|---|---|---|
| 4,208,761 | A * | 6/1980 | Ionescu | 15/304 |
| 4,883,542 | A | 11/1989 | Voneiff | |
| 5,265,298 | A * | 11/1993 | Young | 15/1.51 |
| 2007/0240784 | A1 | 10/2007 | Wu et al. | |

FOREIGN PATENT DOCUMENTS

| | | |
|---|---|---|
| EP | 1048365 | 2/2000 |
| EP | 1882531 | 1/2008 |

* cited by examiner

*Primary Examiner* — Saeed T Chaudhry
(74) *Attorney, Agent, or Firm* — Occhiuti & Rohlicek LLP

(57) ABSTRACT

The invention relates to a method and to a device for treating containers relating especially to cleaning plastic bottles (1) preferably in the inverted position. Each container is thereby subjected to a treatment medium (16) applied and/or introduced thereto. Electrically charged ions introduced into the treatment medium (16) serve to balance the charge of each container. According to the invention, the treatment medium (16) is tested for the presence of ions.

20 Claims, 2 Drawing Sheets

METHOD AND DEVICE FOR TREATING CONTAINERS

CROSS-REFERENCE TO RELATED APPLICATIONS

This application is the National Stage of International Application No. PCT/EP2009/008975, filed on Dec. 15, 2009, which claims the priority of German Patent Application No. 10 2008 062 378.4, filed on Dec. 17, 2008. The contents of both applications are hereby incorporated by reference in their entirety.

FIELD OF DISCLOSURE

The invention concerns a method and a device for treating containers, particularly for the cleaning of bottles, preferably plastic bottles, in an inverted position according to which a treatment medium, which is applied and/or introduced, to the relevant container, and according to which electrically charged ions, which have been introduced into the treatment medium, serve to balance the charge equalisation of each container.

BACKGROUND

Containers, and here particularly bottles, are routinely cleaned either for refilling or before first filling. The same applies to cans or similar containers. So-called rinsers are known in which new bottles are blown out before being filled or sterile air being applied, in order to remove any possible dust or dirt particles, resulting from the manufacturing process, from the containers. When pure plastic bottles are used, this procedure sometimes poses problems due to the electrostatic charging of these bottles. Dirt particles in the ambient air are additionally attracted or existing particles show a strong adhesion.

For this reason it has already been proposed in EP 1 048 365 B1 to ionise the treatment medium, in order to totally or completely remove the inherent or adherent electrostatic charge of the container or to neutralise it. The adhesion of dirt particles is reduced through this charge equalisation and therefore the cleaning effect is improved significantly. This has proven to be successful.

SUMMARY

However, problems can possibly arise if the number of electrically charged ions introduced to the treatment medium for charge equalisation of the container which must be treated fluctuates and/or if the external conditions change. For example, this can happen when the surrounding atmosphere changes with regard to humidity which has a knock on effect on the electrostatic charging of the bottles or plastic bottles which must be treated. This is where the invention comes into play.

The invention is based on the technical problem of further developing a method and a device for the treatment of containers in such a way that the charge equalisation of the respective container which must be treated, is impeccable.

For the solution of this technical problem, provision has been made for a type of method for the treatment of containers, in which a check is performed for the presence of the ions.

In the majority of cases the treatment medium containing the ions is checked for the presence of ions. However, it is also conceivable that a check for the presence of ions can be performed without checking the treatment medium. For example the function of a discharge electrode or generally of an ionising element for the generation of electrically charge ions can be checked regarding its function. In this respect, it is conceivable that the ions directly impact on the measuring element. Besides this, the measuring element can be contacted by the treatment medium and the ions contained therein. In the same way it is conceivable to transport the ions with the aid of a replacement medium or another medium—instead of the treatment medium—and to feed them to the measuring element in question. This means that the ions can be generated and checked separately from the treatment medium. Of course, simultaneous generation of the ions and the treatment medium also falls within the scope of the invention and is propagated because in the end, the treatment medium functions as a carrier for the ions.

This means that according to the invention the ions are still generated, namely generally with the aid of an ionising element, which is an ionising electrode or which contains such an electrode, as is described in detail in EP 1 048 365 B1. The electrically charged ions generated by this ionising element are introduced into the treatment medium and according to the invention, a check is performed for the presence of ions in the treatment medium. This check can not only capture the presence of such ions in principle, but also the number of ions per unit of time. This allows conclusions regarding the ion current to be made.

It has proved successful if the check for ions in the treatment medium is performed during the treatment of the containers, i.e. simultaneously with the actual production process or the cleaning of the containers. The check can be performed continuously and/or at certain time intervals. The check results can not only be used in the sense of impeccable operation of the ionising element being captured. But the check results can, if applicable, also be used to control the ionising element.

This means that depending on, for instance, the number of ions present in the treatment medium, i.e. the ion current, the ionising element can be controlled in order to provide the required ion current. This process can, of course, not only be used for control purposes, but can also be implemented in conjunction with a control system in such a way that a specific ion current is set to be emitted by the ionising element and is then checked in the treatment medium. For this purpose, the invention regularly uses a sample or a test element or generally a measuring element, which is contacted by the treatment medium.

It has proven to be very advantageous if the step of checking the treatment medium is performed during the dead time during production or during the production process. Such dead times occur regularly because the containers which must be treated are taken through a treatment section, which contains a dead zone. Normally the treatment section is a circular path because the containers are contacted by the treatment medium along a rotor. Between an in-feed area and a discharge area on the periphery of the rotor there is a dead zone where no treatment or cleaning takes place or can take place, which is used favourably within the scope of the invention for checking the treatment medium for the presence of ions.

This dead zone is normally designed as a dead angle due to the design of the treatment section as a circular path. The measuring element or the sample can cover the dead zone completely or nearly completely or even only partially. The presence of ions within the dead zone or within the dead angle is checked with the aid of the measuring element or the sample. The treatment medium can be switched off during this process. It is, however, possible to work with a replacement medium instead of the treatment medium as ion carrier.

This means the generation of ions and the supply of treatment medium can be applied separately or simultaneously.

The sample or the test element is regularly checked regarding its charge condition before and/or after being contacted by the treatment medium in order to establish the presence of ions in the treatment medium beyond any doubt. This can be accomplished by means of a discharge element to which the ionising element has been assigned and which discharges the treatment medium with the ions introduced to it, and impinges on the measuring element or the sample, thereby checking for a certain quantity of ions. As described, this charge quantity can be transferred to the measuring element or the sample, whereby the possibility exists to remove a certain charge quantity form the measuring element or from the sample. This can happen, for instance, when the treatment medium is loaded with positively charged ions and when these positively charged ions impinge on the measuring element or the sample and a corresponding number of electrons leave the measuring element or the sample in order to neutralise the positively charged ions in the treatment medium.

In any case the charge condition can be checked with the aid of the measuring element or the sample and in addition by using a measuring device connected to the measuring element, both before and after impingement by the treatment medium. From possible differences between the check results or the associated measured charge conditions, deductions can be made regarding the presence or absence of ions in the treatment medium. This allows an unequivocal check of the ionising function of the treatment medium, which is not possible with the state of technology up to now.

Possible changes in the charge condition of the measuring element or the sample can generally be derived from voltage and current profiles, because the sample or the measuring element mostly forms a closed (direct current) circuit in conjunction with a measuring device and a power supply. If the number of transported charges changes in this closed circuit because the treatment medium, which is loaded with electrically charged ions, changes the free charges within the measuring element or the sample, the measuring device detects such changes of the charge condition as fluctuations of the voltage, changes of the voltage profile or generally the amount of transmitted current can be captured.

All check results now present information whether sufficient electrically charged ions are present in the treatment medium, and if so, whether the quantity is sufficient to ensure the required charge equalisation of the container, which must be treated. If, for instance, the quantity of ions present inn the treatment medium should be insufficient, then the ionising element or the discharge electrode which is usually provided here, can be supplied with a higher voltage and/or a higher current until the required number of ions is present in the treatment medium. As explained, this process can be implemented by means of a control system.

A device for the treatment of containers, as described in claim 7 and subsequent claims in detail, is also part of the invention.

The results make provision for a method and a device for the treatment of containers, particularly bottles and preferably plastic bottles, that allow very efficient cleaning of containers. In essence this is attributable to the fact that a possible electrostatic charge of the bottles which must be treated, is counteracted. For this purpose, the treatment medium disposes of electrically charged ions which were introduced for the charge equalisation of the relevant container.

According to the invention, the presence of these ions and, if applicable, the quantity of ions and in summary the ion current in the treatment medium or the medium flow is investigated. In this way it can be ensured that ions are present at all, and if so, whether the required quantity is present.

Irrespective of this, the invention also uses a measuring element designed as a measuring device besides the measuring element which is designed as a sample and which is directly contacted by the treatment medium. Such a measuring device can be assigned to the ionising element and can, for instance, measure the voltage of the discharge electrode which is implemented here, as well as the discharge current, if applicable. Normally these parameters allow additional or alternative conclusions regarding the presence of electrically charged ions in the treatment medium and/or regarding the ion current.

Normally, however, both methods are combined in such a way that on the one hand provision is made for the measuring device assigned to the ionising element and on the other hand provision is made for the additional sample, which is impinged by the treatment medium with the electrically charged ions. In any case the invention allows impeccable checking of the discharge element or the ionising jets which are in most cases implemented here, so that it can be checked whether sufficient numbers of electrically charged ions are present in the treatment medium. It is only as a result of this that it is possible to achieve guaranteed cleaning of the plastic containers. This represents the essential advantages.

The invention is subsequently explained in more detail with the help of a drawing, which merely serves as a design example:

DETAILED DESCRIPTION

Figure 1:
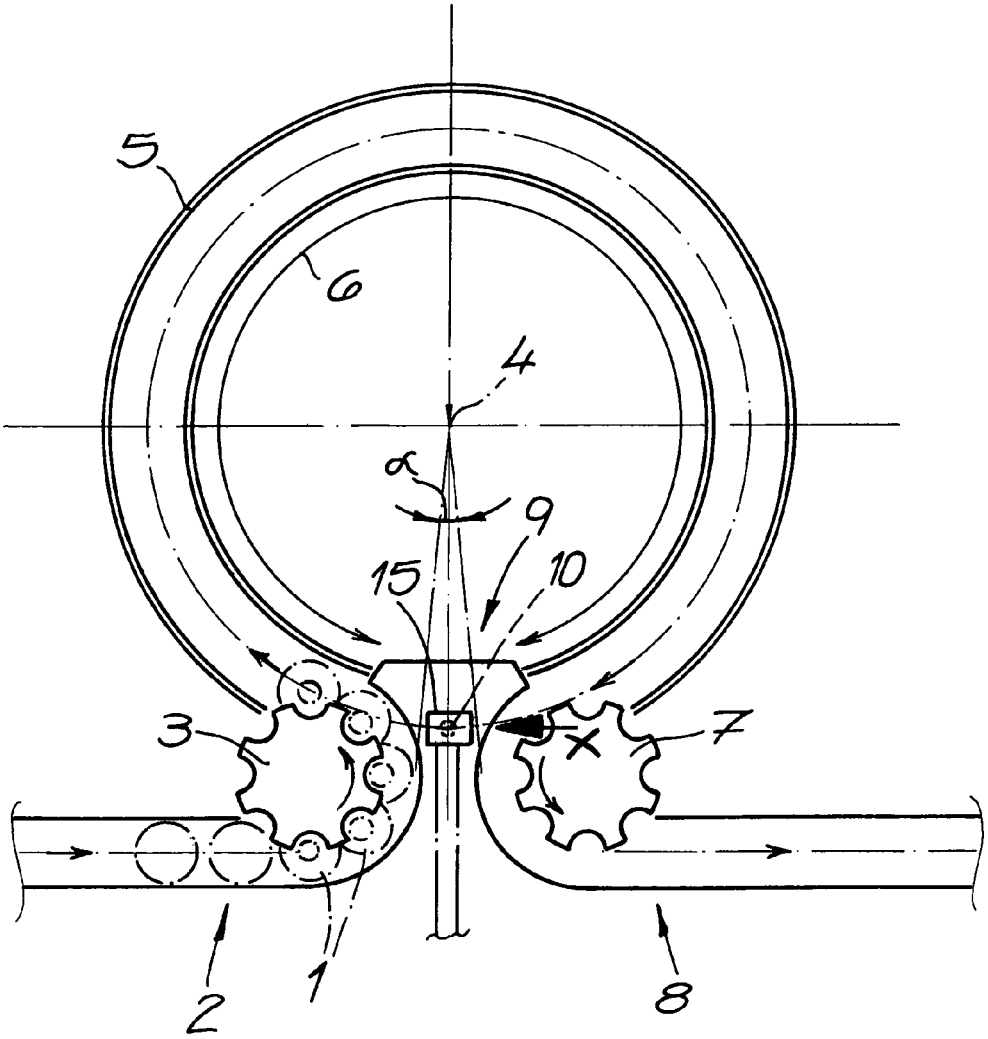
FIG. 1 Schematic presentation of the device for the treatment of containers according to the invention, and FIG. 2 A side elevation of the object according to FIG. 1 in the direction X.

The figures show a device for the treatment of containers, whereby it is not limited to only plastic bottles 1. As is shown in FIG. 1, these plastic bottles 1 are transferred via a container feed 2 to an in-feed star 3, which hands over the plastic bottles 1 to a rotor 5 which rotates around at vertical axis 4 and where the actual cleaning of the plastic bottles 1 is performed during the rotation. Indeed the plastic bottles 1 traverse a treatment section 6 on their way along the rotor 5, which reaches from the in-feed star 3 to the discharge star 7, which transfers the plastic bottles 1 to a container discharge 8 after treatment.

Figure 2:
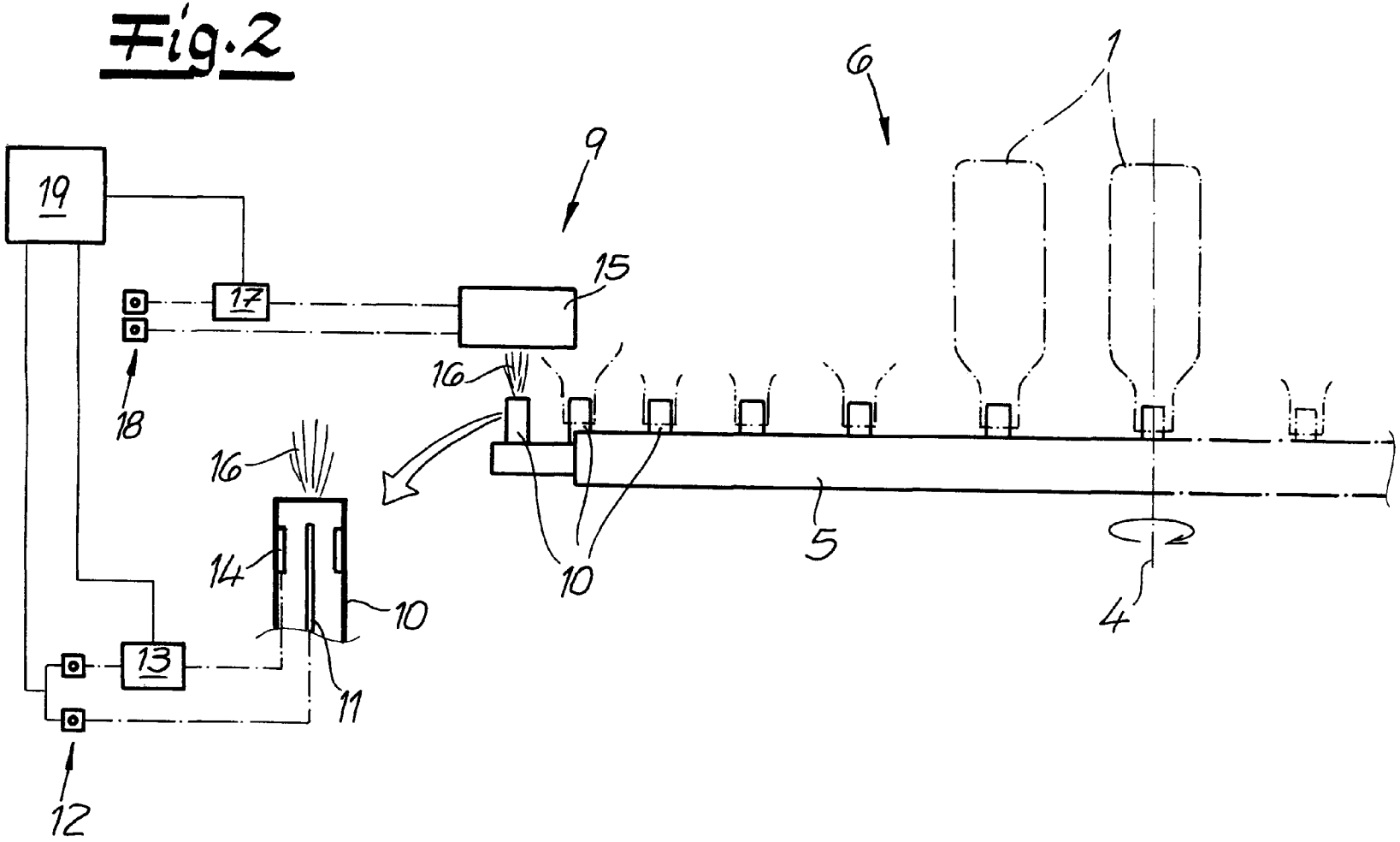

In the example the treatment section 6 is designed as a circular path with a dead zone 9, within which no treatment of the plastic bottles 1 takes place. This dead zone 9 corresponds to a dead angle $\alpha$. Within this dead zone 9 or within the dead angle $\alpha$ a check is performed on the treatment medium 16, which is discharged along the treatment section 6 by a discharge element 10, as can best be seen in FIG. 2. The discharge element 10 in the illustrated embodiment concerns a jet 10, which is furnished with an assigned ionising element 11, as is shown in FIG. 2. The ionising element 11 is a discharge electrode 11, which is connected to a high voltage supply 12. In addition there is a measuring device 13 or a measuring element 13 in the associated high voltage circuit, with the aid of which the voltage between the discharge electrode 11 and a counter-electrode 14 can be measured as well as a possible current.

The basic structure additionally contains another measuring element 15 in the form of a sample or test element 15, which is contacted by the treatment medium 16 and which checks the treatment medium 16 for the presence of ions. The treatment medium 16 in the illustrated embodiment does not exclusively include a sterile gas (air), into which electrically charged ions were introduced with the aid of the ionising element 11. Water or another fluid or generally a fluid could also be used as treatment medium 16 instead of gas. In any case, the measuring element or the sample or test element 15 reacts to the presence of ions.

It is possible to operate the ionising element 11 and the discharge element 10 or a device which generates and supplies the treatment medium separately or simultaneously. This means that the ionising element or the discharge electrode 11 can be checked for the generation of ions within the dead zone 9 independently of the supply of the treatment medium with the aid of the test element 15. This means that the supply of treatment medium can be interrupted within the dead zone 9, which then only takes place within the treatment section 6. In this way, the volume of treatment medium 16 can be reduced and is not wasted. Alternatively, it is also possible to work with a replacement medium within the dead zone 19 instead of the treatment medium 16, which serves as carrier of the ions generated by the ionising element 11 to the test element 15.

The measuring element or the sample or the test element 15 has been designed as electrically conductive or has an electrically conductive surface in order to be able to unambiguously prove the presence of ions. The test element 15 is also furnished with a connected measuring device 17 and a power supply 18. In this way a specific electrical charge condition can be created on the surface of the measuring element or the sample 15, which changes on contact with the electrically charged ions in the treatment medium 16. Such a change of the electrical charge condition of the measuring element or the sample or the test element 15 results in the measuring device 17 detecting a change in the voltage at the measuring element 15, or a specific voltage profile or that the current flowing through the measuring element 15 is changing. In principle, the measuring element 15 can also be designed as a semiconductor element the conductivity of which changes as a result of the electrically charged ions contacting same together with the treatment medium 16.

In any case the measuring device 17 is capable of detecting a possible change in the charge condition of the measuring element 15, compared to the original charge condition, which is established when the measuring element 15 is not impinged by the treatment medium 16. From these differences and check results derived from them, conclusion can be drawn, whether the treatment medium 16 contains the introduced electrically charged ions at all, and whether the ions are present in the treatment medium 16 in the required quantity.

The measuring device 15 is normally arranged in the dead zone 9 or in the area of the dead angle $\alpha$, as is shown in FIG. 1. The measuring element 15 can cover the said dead zone 9 completely or almost completely or only partially and be checked continuously or at certain time intervals for the presence of ions. In any case this happens during the production process, because the discharge element 10 and with that the ionising element 11, i.e. the entire relevant ionising jet 10, 11, is circulated. During circulation of the circular path 6, the treatment medium 16 is discharged for cleaning and is checked within the dead zone 9 by the measuring element 15 there.

The operation is as follows. The containers fed in via the bottle in-feed 2 of the device according to the invention, or the plastic bottles 1 in the example are handed over to the rotor 5 by the in-feed star 3 and are moved along the circular path 6. At this stage the plastic bottles 1 are in an upside down position, so that the treatment medium 16 which is discharged from the ionising jets 10, 11, which are moved along with the plastic bottles 1, enters or flows into the plastic bottle 1 through the bottle neck from below. As soon as the individual ionising jets 10, 11 and the respective discharge elements 10, which are moved along with the rotor 5 pass the dead zone 9, supply of the treatment medium 16 would normally be stopped.

However, according to the invention a check on the treatment medium 16 now follows in the dead zone 9, whether the required number of electrically conducting ions is present. For this purpose the treatment medium 16 comes into contact with the measuring element or the sample or the test element 15 in the dead zone 9. Any possible changes in the original charge condition of the measuring element 15 is now detected with the aid of the measuring device 17. From these check results it can be concluded whether ions are present in the treatment medium 16 at all, and if so, whether the required quantity is present. This means that the measuring device 17 measures the ion current carried along with the treatment medium 16.

In a preferable design, the relevant check results can now be saved and evaluated in a control system 19, which is connected to the measuring device 17. It is also possible that the control system 19 correspondingly controls the ionising element 11 or the discharge electrode 11 or its assigned power supply 12, which are assigned to the discharge element 10, depending on the check results. If, for instance, the number of electrically charged ions in the treatment medium 16 is insufficient, then the control system 19 controls the voltage or power supply 12 for the supply of the ionising element 11 correspondingly in order to increase the number of ions generated. This can be accomplished in the sense of a control system. Because the number of electrically charged ions in the treatment medium 16 generated by the ionising element 11 is detected immediately thereafter by means of the measuring element 15 of the measuring device 17, constituting the closed loop control system.

In addition it can be detected in the high voltage circuit with the aid of the measuring device 13, which voltage is applied to the ionising element 11 and which currents result. These values can also be evaluated by the control system 19 in order to control the voltage or power supply 12 to the ionising element 11 accordingly.

The invention claimed is:

1. A method for treating containers, said method comprising: applying and/or introducing, to an inverted container, a treatment medium into which ions have been introduced to neutralize charge on the inverted plastic battle, and checking the treatment medium for presence of the ions.

2. The method of claim 1, wherein checking the treatment medium for the presence of ions is performed during treatment of the container.

3. The method of claim 1, further comprising using results of the checking for control of an ionizing element.

4. The method of claim 1, wherein checking comprises contacting a measuring element with the treatment medium.

5. The method of claim 4, wherein checking comprises checking the measuring element before and after the measuring element is contacted by the treatment medium.

6. The method of claim 1, wherein checking the treatment medium for the presence of the ions is performed during dead times during production.

7. The method of claim 1, wherein said container is a plastic container.

8. An apparatus for treatment of inverted containers, said apparatus comprising: a discharge element for applying or introducing a treatment medium into an inverted container, an ionizing element assigned to the discharge element for generation of ions and the introduction thereof into the treatment medium in order to achieve charge neutralization of the container, and a measuring element to check for the presence of ions in treatment medium.

9. The apparatus of claim 8, wherein the measuring element is electrically conductive.

10. The apparatus of claim 8, wherein the measuring element is arranged in a dead zone of a treatment section.

11. The apparatus of claim 10, wherein the treatment section is designed as a circular path, and wherein the dead zone is designed as a dead angle.

12. The apparatus of claim 10, wherein the measuring element completely covers the dead zone.

13. The apparatus of claim 10, wherein the measuring element almost completely covers the dead zone.

14. The apparatus of claim 8, wherein the measuring element comprises a connected measuring device in order to check the charge condition before and/or after application of the treatment medium.

15. The apparatus of claim 8, wherein the measuring element is connected to a power supply in order to set a specific charge condition.

16. The apparatus of claim 8, wherein the measuring element is configured as a sample or test element.

17. The apparatus of claim 8, wherein the measuring element is configured as a measuring device for the ionizing element.

18. The apparatus of claim 8, wherein said container is a plastic container.

19. An apparatus for treatment of inverted containers, said apparatus comprising: means for applying or introducing a treatment medium to the inverted container, means for generating ions for introduction into the treatment medium to achieve charge neutralization of the inverted container, and means for checking the treatment medium for presence of ions.

20. The apparatus of claim 19, wherein said container is a plastic container.

* * * * *